US007816844B2

(12) United States Patent
Cha et al.

(10) Patent No.: US 7,816,844 B2
(45) Date of Patent: Oct. 19, 2010

(54) FILTER AND PLASMA DISPLAY DEVICE THEREOF

(75) Inventors: Hong Rae Cha, Seoul (KR); Ji Hoon Sohn, Seoul (KR); Sam Je Cho, Seoul (KR); Woo Sung Jang, Seoul (KR); Woon Seo Shin, Seoul (KR); Kang Yoon Kim, Seoul (KR); Seoung Won Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 341 days.

(21) Appl. No.: 11/839,601

(22) Filed: Aug. 16, 2007

(65) Prior Publication Data

US 2008/0042569 A1 Feb. 21, 2008

(30) Foreign Application Priority Data

Aug. 18, 2006 (KR) ..... 10-2006-0078264
Mar. 5, 2007 (KR) ..... 10-2007-0021563
Mar. 30, 2007 (KR) ..... 10-2007-0031268

(51) Int. Cl.
*H01J 5/16* (2006.01)
*H01K 1/26* (2006.01)

(52) U.S. Cl. ..... 313/112; 313/582; 313/111

(58) Field of Classification Search ..... 313/112, 313/582, 111, 586, 583, 584, 587, 110, 113, 313/114; 359/599
See application file for complete search history.

(56) References Cited

U.S. PATENT DOCUMENTS 3,279,314 A * 10/1966 Miller ..... 359/453
5,061,874 A * 10/1991 Hecq et al. ..... 313/478
5,973,450 A * 10/1999 Nishizawa et al. ..... 313/478
6,333,597 B1 12/2001 Mitomo
6,937,399 B2 * 8/2005 Takahashi et al. ..... 359/599
6,954,031 B2 * 10/2005 Hashimoto et al. ..... 313/503
7,042,150 B2 * 5/2006 Yasuda ..... 313/498
2004/0263061 A1 * 12/2004 Ishikawa et al. ..... 313/501

(Continued)

FOREIGN PATENT DOCUMENTS

EP 1 414 069 A2 4/2004

(Continued)

OTHER PUBLICATIONS

European Search Report dated May 29, 2009 for Application No. 01774354.9, 6 pages.

*Primary Examiner*—Peter J Macchiarolo
*Assistant Examiner*—Glenn Zimmerman
(74) *Attorney, Agent, or Firm*—Fish & Richardson P.C.

(57) ABSTRACT

The plasma display device comprises a plasma display panel and the filter which is formed at a front of the plasma display panel, wherein the filter includes an external light shielding sheet which comprises a base unit, and a plurality of pattern units formed on the base unit, wherein a bottom of the pattern units, which is wider than a top of the pattern units, comprises a concave having a curvature. The device can improve bright room contrast. Also, the sharpness of the display images may be enhanced by reducing the bleeding phenomenon of the display images as well as the adhesiveness of the filter may be enhanced by forming the bottom of the pattern units of the external light shielding sheet as a concave shape in which the center area is depressed into the inside.

17 Claims, 15 Drawing Sheets

U.S. PATENT DOCUMENTS

| | | | | |
|---|---|---|---|---|
| 2004/0263062 | A1* | 12/2004 | Fujii | 313/501 |
| 2005/0174511 | A1 | 8/2005 | Sugawara | |
| 2005/0231085 | A1* | 10/2005 | Song et al. | 313/110 |
| 2005/0253493 | A1 | 11/2005 | Park | |
| 2006/0145578 | A1* | 7/2006 | Park et al. | 313/112 |
| 2006/0250064 | A1* | 11/2006 | Park et al. | 313/112 |
| 2007/0075641 | A1* | 4/2007 | Yu | 313/587 |
| 2007/0133094 | A1* | 6/2007 | Walton et al. | 359/599 |
| 2007/0152592 | A1* | 7/2007 | Kim et al. | 313/586 |
| 2007/0223867 | A1* | 9/2007 | Hwang et al. | 385/123 |
| 2007/0228914 | A1* | 10/2007 | Kim et al. | 313/111 |
| 2007/0228953 | A1* | 10/2007 | Soh et al. | 313/582 |

FOREIGN PATENT DOCUMENTS

| | | | |
|---|---|---|---|
| EP | 1 677 336 | A2 | 7/2006 |
| WO | WO 03/042726 | A1 | 5/2003 |

* cited by examiner

FILTER AND PLASMA DISPLAY DEVICE THEREOF

BACKGROUND OF THE INVENTION

1. Field of the Invention

The present invention relates to a plasma display device, and more particularly, to a plasma display device in which an external light shielding sheet is disposed at a front of a panel in order to shield external light incident upon the panel so that the bright room contrast of the panel is enhanced while maintaining the luminance of the panel.

2. Description of the Conventional Art

Generally, a plasma display panel (PDP) displays images including text and graphic images by applying a predetermined voltage to a plurality of electrodes installed in a discharge space to cause a gas discharge and then exciting phosphors with the aid of plasma generated as a result of the gas discharge. The PDP is easy to manufacture as large-dimension, light and thin flat displays. In addition, the PDP has advantages in that it can provide wide vertical and horizontal viewing angles, full colors and high luminance.

However, the PDP has a disadvantage in that the contrast is degraded because black images are recognized as being brighter than they actually are, since external light is reflected on a front surface of the panel due to white phosphors exposed at a lower substrate of the panel when the PDP realizes black images.

SUMMARY OF THE INVENTION

According to an aspect of the present invention, there is provided a plasma display device, including a plasma display panel (PDP); and a filter which is formed at a front of the PDP. The filter includes an external light shielding sheet which is composed of a base unit, and a plurality of pattern units that are formed on the base unit, wherein a bottom, which is wider than a top, of the pattern units is formed as a concave shape.

According to an aspect of the present invention, there is provided a filter, including an external light shielding sheet which is composed of a base unit; and a plurality of pattern units that are formed on a groove of the base unit, wherein a bottom, which is wider than a top, of the pattern units is formed as a concave shape.

DETAILED DESCRIPTION OF THE PREFERRED EMBODIMENT

Figure 1:
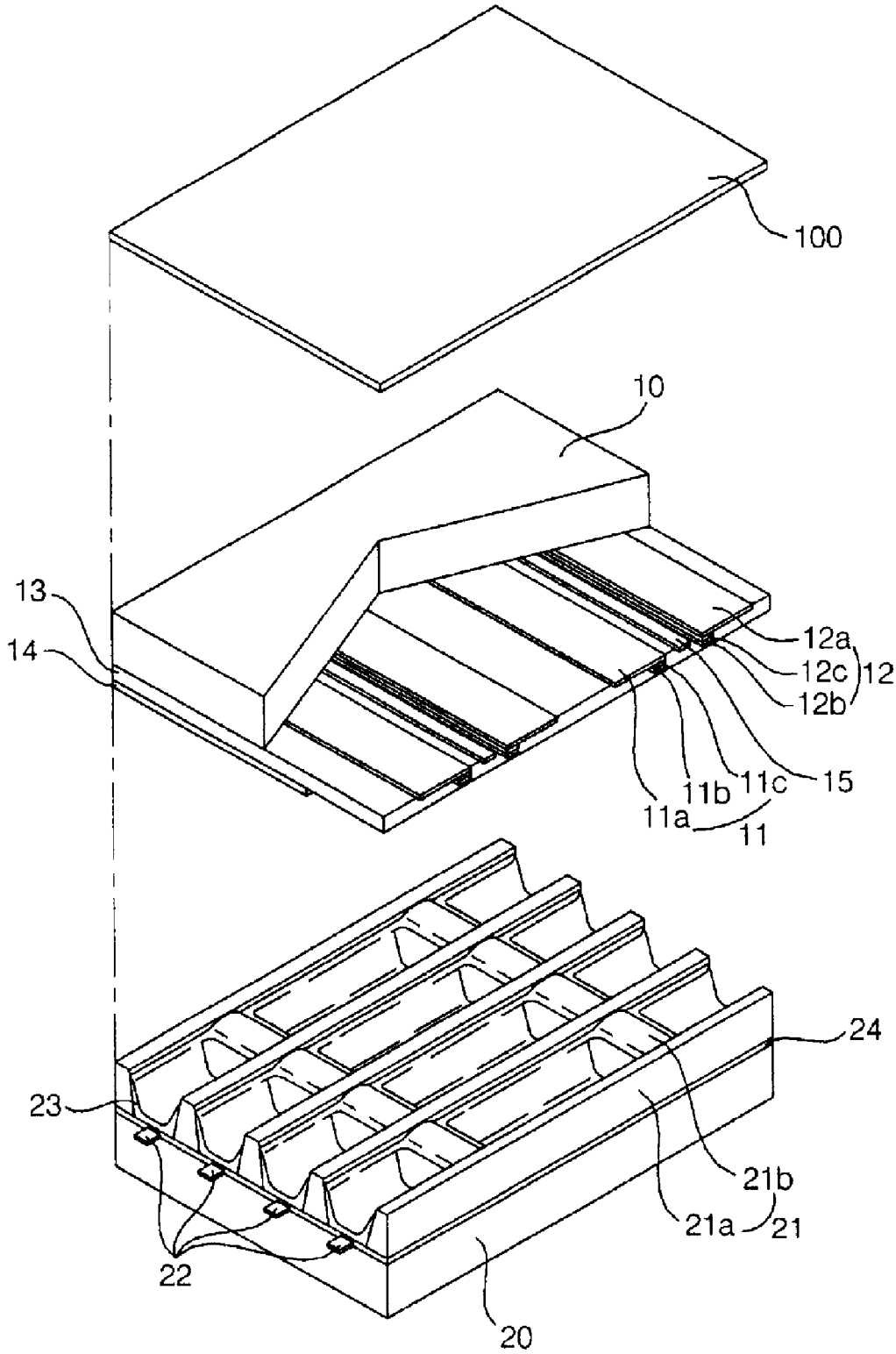
FIG. 1 is a perspective view illustrating a structure of a plasma display panel according to an embodiment of the present invention.

Hereinafter, the present invention will be described in detail with reference to the accompanying drawings, in which exemplary embodiments of the invention are shown. FIG. 1 is a perspective view illustrating a structure of a plasma display panel according to an embodiment of the present invention.

As shown in FIG. 1, the PDP includes a scan electrode 11 and a sustain electrode 12, which are a sustain electrode pair formed on an upper substrate 10, and an address electrode 22 formed on a lower substrate 20.

The sustain electrode pair 11 and 12 includes transparent electrodes 11*a* and 12*a* and bus electrodes 11*b* and 12*b* that are generally made of indium—tin-oxide (ITO). The bus electrodes 11*b* and 12*b* can be made of a metal such as silver (Ag) and chrome (Cr) or can be made with a stacked structure of chrome/copper/chrome (Cr/Cu/Cr) or chrome/aluminum/chrome (Cr/Al/Cr). The bus electrodes 11*b* and 12*b* are formed on the transparent electrodes 11*a* and 12*a* to reduce voltage drop due to the transparent electrodes 11*a* and 12*a* having high resistance.

Meanwhile, according to an embodiment of the present invention, the sustain electrode pair 11 and 12 can be composed of a stacked structure of the transparent electrodes 11*a* 12*a* and the bus electrodes 11*b* and 12*b* or only the bus electrodes 11*b* and 12*b* without the transparent electrodes 11*a* and 12*a*. Because the latter structure does not use the transparent electrodes 11*a* and 12*a*, there is an advantage in that a cost of manufacturing a panel can be decreased. The bus electrodes 11*b* and 12*b* used in the structure can be made of various materials such as a photosensitive material in addition to the above-described materials.

A black matrix (BM) 15, which performs a light shielding function of reducing reflection by absorbing external light that is generated from the outside of the upper substrate 10 and a function of improving purity and contrast of the upper substrate 10 may be arranged between the transparent electrodes 11*a* and 12*a* and the bus electrodes 11*b* and 12*b* of the scan electrode 11 and the sustain electrode 12.

The black matrix 15 according to an embodiment of the present invention is formed in the upper substrate 10 and includes a first black matrix 15 that is formed in a position that is overlapped with a barrier rib 21 and second black matrixes 11*c* and 12*c* that are formed between the transparent electrodes 11*a* and 12*a* and the bus electrodes 11*b* and 12*b*. Here, the first black matrix and the second black matrixes 11*c* and 12*c* that are also referred to as a black layer or a black electrode layer may be physically connected to each other when they are formed at the same time in a forming process or may be not physically connected to each other when they are not formed at the same time.

In addition, when they are physically connected to each other, the first black matrix 15 and the second black matrixes

11*c* and 12*c* are made of the same material, but when they are physically separated from each other, they may be made of other materials.

The bus electrodes 11*b* and 12*b* or the barrier rib 21 may perform a light shielding function of reducing reflection by absorbing external light that is generated from the outside and a function of improving contrast, as the bus electrodes 11*b* and 12*b* or the barrier rib 21 have/has a dark color.

An upper dielectric layer 13 and a protective film 14 are stacked in the upper substrate 10 in which the scan electrode 11 and the sustain electrode 12 are formed in parallel. Charged particles, which are generated by a discharge may be accumulated in the upper dielectric layer 13 and perform a function of protecting the sustain electrode pair 11 and 12. The protective film 14 protects the upper dielectric layer 13 from sputtering of charged particles that are generated at a gas discharge and enhances emission efficiency of a secondary electron.

In addition, the address electrode 22 is formed in an intersecting direction of the scan electrode 11 and the sustain electrode 12. Furthermore, a lower dielectric layer 24 and a barrier rib 21 are formed on the lower substrate 20 in which the address electrode 22 is formed.

In addition, a phosphor layer 23 is formed on the surface of the lower dielectric layer 24 and the barrier rib 21. In the barrier rib 21, a vertical barrier rib 21*a* and a horizontal barrier rib 21*b* are formed in a closed manner and the barrier rib 21 physically divides a discharge cell and prevents ultraviolet rays and visible light that are generated by a discharge from leaking to adjacent discharge cells.

Referring to FIG. 1, a filter 100 is preferably formed on the front surface of the PDP according to the present invention, and also an anti-reflection (AR) layer, a near infrared (NIR) shielding layer and an electromagnetic interference (EMI) layer may further be attached on the filter 100.

In case that the distance between the filter 100 and the PDP is 10 μm to 30 μm, it is possible to effectively shield light incident upon the PDP and to effectively emit light generated from the panel to the outside. Also, the distance between the filter 100 and the PDP may be 10 μm to 120 μm in order to protect the PDP from the exterior pressure, and an adhesion layer, which absorbs impact, may be formed between the filter 100 and the PDP.

In an embodiment of the present invention, various shapes of barrier rib 21 structure as well as the barrier rib 21 structure shown in FIG. 1 can be used. For example, a differential barrier rib structure in which the vertical barrier ribs 21*a* and the horizontal barrier ribs 21*b* have different heights, a channel type barrier rib structure in which a channel, which can be used as an exhaust passage is formed in at least one of the vertical barrier ribs 21*a* and the horizontal barrier ribs 21*b*, and a hollow type barrier rib structure in which a hollow is formed in at least one of the vertical barrier ribs 21*a* and the horizontal barrier ribs 21*b*, can be used.

In the differential type barrier rib structure, it is more preferable that a height of the horizontal barrier ribs 21*b* is greater than that of the vertical barrier ribs 21*a* and in the channel type barrier rib structure or the hollow type barrier rib structure, it is preferable that a channel or a hollow is formed in the horizontal barrier ribs 21*b*.

Meanwhile, in an embodiment of the present invention, it is described as each of R, G, and B discharge cells is arranged on the same line, but they may be arranged in other shapes. For example, delta type of arrangement in which the R, G, and B discharge cells are arranged in a triangle shape may be also used. Furthermore, the discharge cell may have various polygonal shapes such as a quadrilateral shape, a pentagonal shape, and a hexagonal shape.

Furthermore, the phosphor layer 23 emits light by ultraviolet rays that are generated at a gas discharge and generates any one visible light among red color R, green color G, or blue color B light. Here, inert mixed gas such as He+Xe, Ne+Xe, and He+Ne+Xe for performing a discharge is injected into a discharge space that is provided between the upper/lower substrates 10, 20 and the barrier rib 21.

Figure 2:
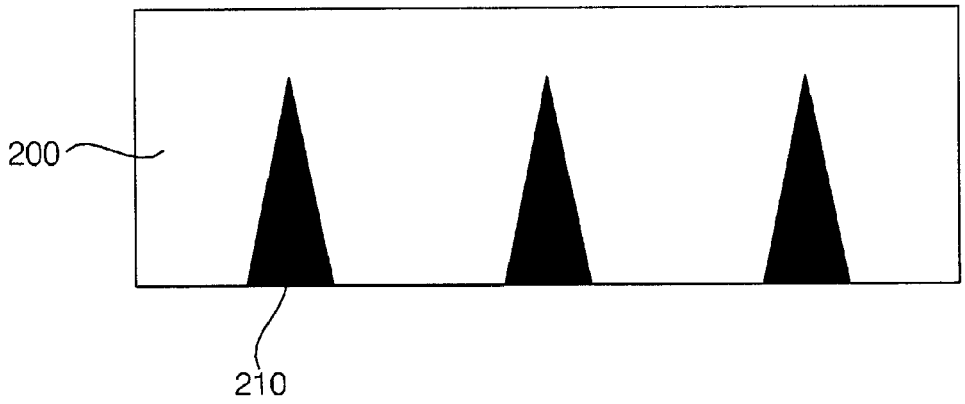
FIG. 2 is a cross sectional view illustrating a structure of an external light shielding sheet according to the present invention.

FIG. 2 is a cross-sectional view of an external light shielding sheet that is included in a filter according to an embodiment of the present invention. The external light shielding sheet is composed of a base unit 200 and a plurality of pattern units 210.

The base unit 200 is preferably formed of a transparent plastic material, for example a UV-hardened resin-based material, so that light can smoothly transmit therethrough. Alternately, the base unit is possible to use a hard glass material to protect the front of the panel.

Referring to FIG. 2, the pattern units 210 may formed as various shapes as well as triangles. The pattern units 210 are formed of a darker material than the base unit 200. For example, the pattern units 210 are formed of a black carbon-based material or covered with a black dye in order to maximize the absorption of external light. Hereinafter, a wider one between a top and a bottom of the pattern units 210 is referred to as a bottom.

According to FIG. 2, a bottom of the pattern units 210 may be arranged at a panel side, and a top of the pattern units 210 may be arranged at a viewer side on which external light incident. In addition, it is also possible that a bottom of the pattern units 210 may be arranged at a viewer side, and a top of the pattern units 210 may be arranged at a panel side.

In general, an external light source is mostly located over the panel, and thus external light is incident on the panel from the top side at an angle and absorbed in the pattern units 210.

The pattern unit 210 may include a light-absorbing particle, and the light-absorbing particle may be a resin particle colored by a specific color. In order to maximize the light absorbing effect, the light-absorbing particle is preferably colored by a black color.

In order to maximize the absorption of external light and to facilitate the manufacture of the light-absorbing particle and the insertion into the pattern units 210, the size of the light-absorbing particle may be 1 μm or more. Also, in case that the size of the light-absorbing particle is 1 μm or more, the pattern units 210 may include the light-absorbing particle 10% weight or more in order to absorb external light more effectively. That is, the light-absorbing particle 10% weight or more of the total weight of the pattern unit 210 may be included in the pattern unit 210.

Figure 3:
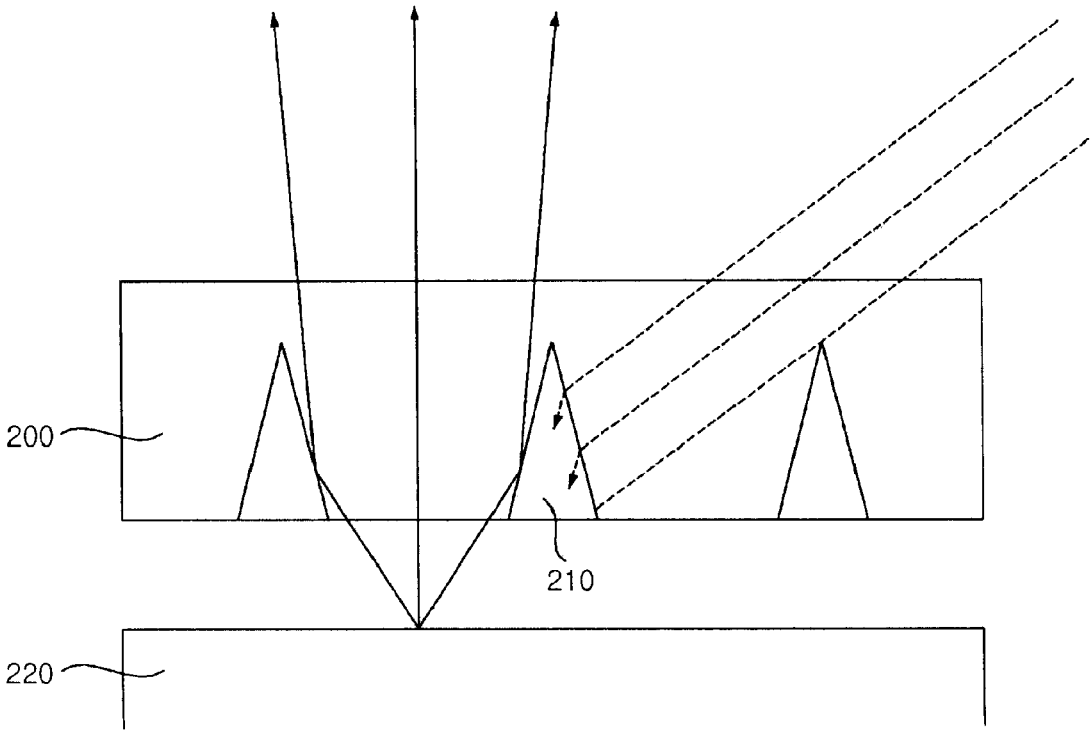
FIG. 3 is a cross sectional view for explaining a function of an external light shielding sheet.

FIG. 3 is a cross-sectional view illustrating a structure of an external light shielding sheet according to an embodiment of the present invention in order to explain an optical property in accordance with the structure of the external light shielding sheet.

According to FIG. 3, the refractive index of the pattern units 210, at least a slanted surface of the pattern units 210, is lower than the refractive index of the base unit 200 in order to absorb and shield external light and to enhance the reflection ratio by total reflecting light emitted from the panel.

As described in the above, external light which reduces the bright room contrast of the PDP is highly likely to be above the panel. Referring to FIG. 3, according to Snell's law, external light (illustrated as a dotted line) that is diagonally incident upon the external light shielding sheet is refracted into and absorbed by the pattern units 210 which have a lower refractive index than the base unit 200. External light refracted into the pattern units 210 may be absorbed by the light-absorbing particle.

Also, light (illustrated as a solid line) that is emitted from the panel 220 for displaying is totally reflected from the slanted surface of the pattern units 210 to the outside, i.e., toward the viewer.

As described above, external light (illustrated as a dotted line) is refracted into and absorbed by the pattern units 210 and light (illustrated as a solid line) emitted from the panel 220 is totally reflected by the pattern units 210 because the angle between the external light and the slanted surface of the pattern units 210 is greater than the angle between the light emitted from the panel 220 and the slanted surface of the pattern units 210, as illustrated in FIG. 3.

Therefore, the external light shielding sheet according to the present invention can enhance the bright room contrast of the display image by absorbing the external light to prevent the external light from being reflected toward the viewer and by increasing the reflection of light emitted from the panel 220.

In order to maximize the absorption of external light and the total reflection of light emitted from the panel 220 in consideration of the angle of external light incident upon the panel 220, the refractive index of the pattern units 210 is preferably 0.3-1 times greater than the refractive index of the base unit 200. In order to maximize the total reflection of light emitted from the panel 220 in consideration of the vertical viewing angle of the PDP, the refractive index of the pattern units 210 is preferably 0.3-0.8 times greater than the refractive index of the base unit 200.

As described in the above, when a top of the pattern units is arranged at the viewer side and the refractive index of the pattern units 210 is lower than the refractive index of the base unit 200, a ghost phenomenon, that is, the phenomenon that an object is not clearly seen by a viewer may be occurred because light emitted from the panel is reflected on the slanted surface of the pattern units 210 toward the viewer side.

When the refractive index of the pattern units 210 is greater than the refractive index of the base unit 200, according to Snell's law, external light that is incident upon the pattern units 210 is totally absorbed by the pattern units 210. Therefore, the ghost phenomenon may be reduced when the refractive index of the pattern units 210 is greater than the refractive index of the base unit 200. The difference between the refractive index of the pattern units 210 and the refractive index of the base unit 200 is preferably 0.05 in order to prevent the ghost phenomenon by sufficiently absorbing light emitted from the panel that is diagonally incident upon the pattern units 210.

When the refractive index of the pattern units 210 is much greater than the refractive index of the base unit 200, light transmittance ratio of the external light shielding sheet and bright room contrast may be reduced. Therefore, the difference between the refractive index of the pattern units 210 and the refractive index of the base unit 200 is preferably 0.05 in order to prevent the ghost phenomenon and in order not to considerably reduce light transmittance ratio of the external light shielding sheet. Also, the refractive index of the pattern units 210 is preferably 1.0-1.3 times greater than the refractive index of the base unit 200 to maintain the bright room contrast as well as to prevent the ghost phenomenon.

Figure 4:
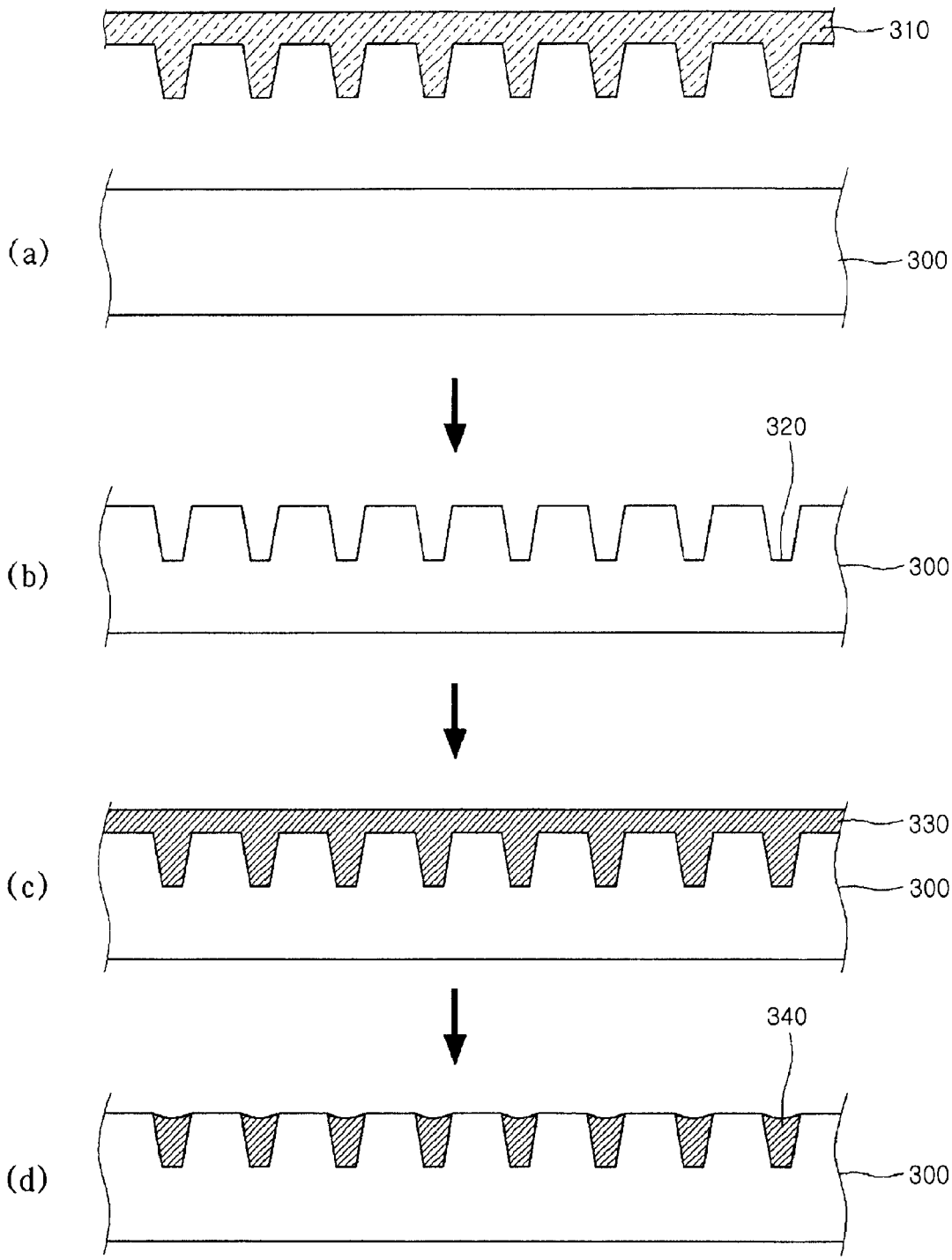
FIG. 4 is a view illustrating a manufacturing method of an external light shielding sheet according to an embodiment of the present invention.

FIG. 4 is a view illustrating a manufacturing method of an external light shielding sheet according to an embodiment of the present invention.

Referring to FIG. 3, a base unit 300 is formed like (a), and a mold 310 having a predetermined pattern is arranged on an upper part of the base unit 300. After that, the pattern is formed on the upper part of the base unit 300 by pressing the mold 310. Therefore, a groove 320 which is depressed at a predetermined depth is formed in the base unit 300.

After that, a dark color material 330 having fluidity is applied onto the upper part of the base unit 300 in which the groove 320 is formed like (c). Then, the pattern units may be formed as the dark color material 330 is filled into the groove 320. Here, the dark color material 330 having fluidity may be in a state of paste or slurry. For example, the dark color material 330 may be formed by mixing carbon particles, organic solvent such as solvent and binder.

After that, the dark color material 330 is removed from the surface of the base unit 300 by using a blade, and a drying process or forming process is processed. So, the organic solvent is vaporized from the dark color material 330 filled into the groove 320, and thus, the pattern units 340 may be formed in the base unit like (d). That is, a groove 320 which is depressed at a predetermined depth is provided in the base unit 300, and the pattern units 340 are formed in the groove 320 of the base unit 300.

Figure 5:
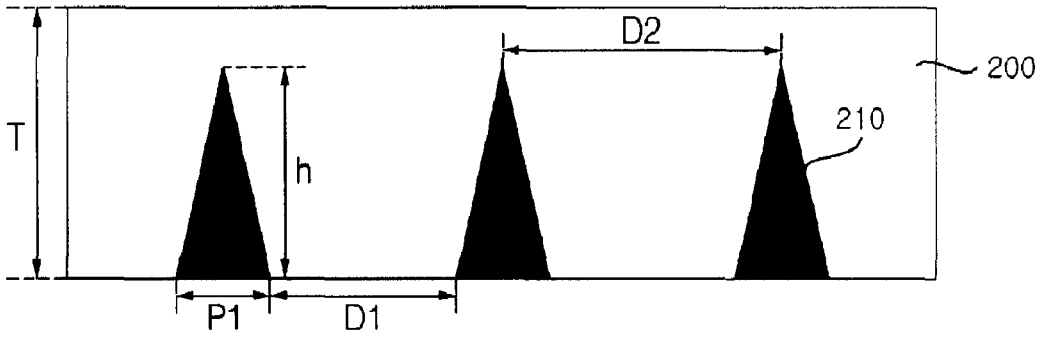
FIGS. 5 and 6 are cross sectional views illustrating a cross sectional shape of an external light shielding sheet according to embodiments of the present invention.

FIG. 5 is a cross sectional view of a structure of an external light shielding sheet included in a filter according to a first embodiment of the present invention. When the thickness T of the external light shielding sheet is 20 μm to 250 μm, the manufacture of the external light shielding sheet can be facilitated and the appropriate light transmittance ratio of the external light shielding sheet can be obtained. The thickness T may be set to 100 μm to 180 μm in order to effectively absorb and shield external light refracted into the pattern units 210 and to enhance the durability of the external light shielding sheet.

Referring to FIG. 5, the pattern units 210 formed on the base unit 200 may be formed as triangles, and more preferably, as equilateral triangles. Also, the bottom width P1 of the pattern units 210 may be 18 μm to 35 μm, and in this case, it is possible to ensure an optimum opening ratio and maximize external light shielding efficiency so that light emitted from the panel can be smooth discharged toward the user side.

The height h of the pattern units 210 is set to 80 μm to 170 μm, and thus the pattern units 210 can form a gradient capable of effectively absorbing external light and reflecting light emitted from the panel. Also, the pattern units 210 can be prevented from being short-circuited.

In order to achieve a sufficient opening ratio to display images with optimum luminance through discharge of light emitted from the panel toward the user side and to provide an optimum gradient for the pattern units 210 for enhancing the external light shielding efficiency and the reflection efficiency, the distance D1 between a pair of adjacent pattern units may be set to 40 μm to 90 μm, and the distance D2 between tops of the pair of adjacent pattern units may be set to 90 μm to 130 μm.

Due to the above-described reasons, an optimum opening ratio for displaying images can be obtained when the distance D1 is 1.1 to 5 times greater than the bottom width P1 of the pattern units 210. Also, in order to obtain an optimum opening ratio and to optimize the external light shielding efficiency and the reflection efficiency, the distance D1 between bottoms of the pair of adjacent pattern units 210 may be set to be 1.5 to 3.5 greater than the bottom width.

When the height h is 0.89 to 4.25 times greater than the distance D1 between the pair of adjacent pattern units, external light diagonally incident upon the external light shielding sheet from above can be prevented from being incident upon the panel. Also, in order to prevent the pattern units 210 from being short-circuited and to optimize the reflection of light emitted from the panel, the height h may be set to be 1.5 to 3 times greater than the distance D1 between the pair of adjacent pattern units.

In addition, when the distance D2 between tops of a pair of adjacent pattern units is 1 to 3.25 times greater than the distance D1 between bottoms of a pair of adjacent pattern units, a sufficient opening ratio for displaying images with optimum luminance can be obtained. Also, in order to maximize the total reflection of light emitted from the panel by the slanted surface of the pattern units 210, the distance D2 between tops of the pair of adjacent pattern units may be set to be 1.2 to 2.5 times greater than the distance D1 between bottoms of the pair of adjacent pattern units.

Figure 6:
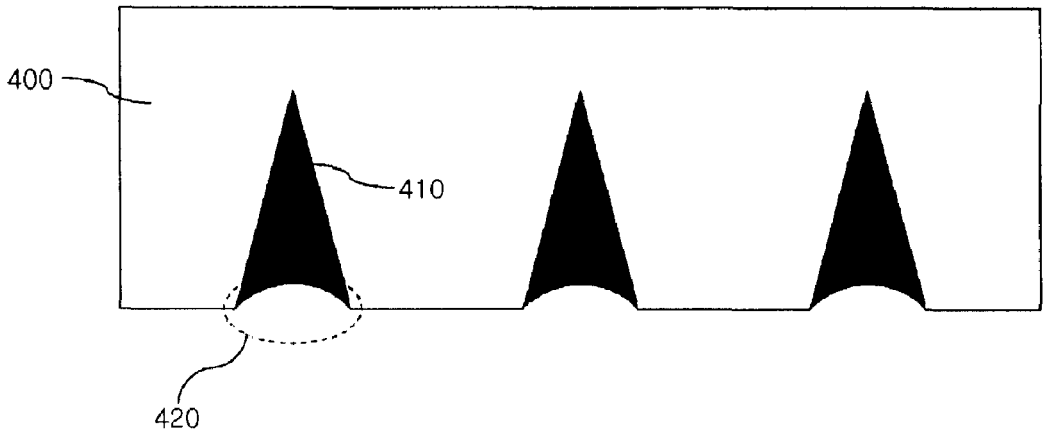

FIG. 6 is a cross sectional view illustrating a shape of pattern units of an external light shielding sheet according to a second embodiment of the present invention.

As shown in FIG. 6, bleeding phenomenon of the image that is generated as light emitted from the panel is reflected on the bottom 420 of the pattern units 410 can be reduced by forming a center of the bottom 420 of the pattern units 410 as a round hole or a concave. Also, when the external light shielding sheet is attached to another functional sheet or the panel, adhesive force can be enhanced as the area of the contact portion is increased.

That is, the pattern units 410 having a concave bottom 420 may be formed by forming the pattern units 410 in which the height of the center area is lower than the height of the outer most contour.

As described in the above, the pattern units 410 may be formed by filling light-absorbing materials into the groove formed in the base unit 400, wherein some of the groovees formed in the base unit 400 may be filled by the light-absorbing materials and the rest of the groovees may be left as an occupied space. Therefore, the bottom 420 of the pattern units 410 may be a concave shape in which the center area is depressed into the inside.

Figure 7:
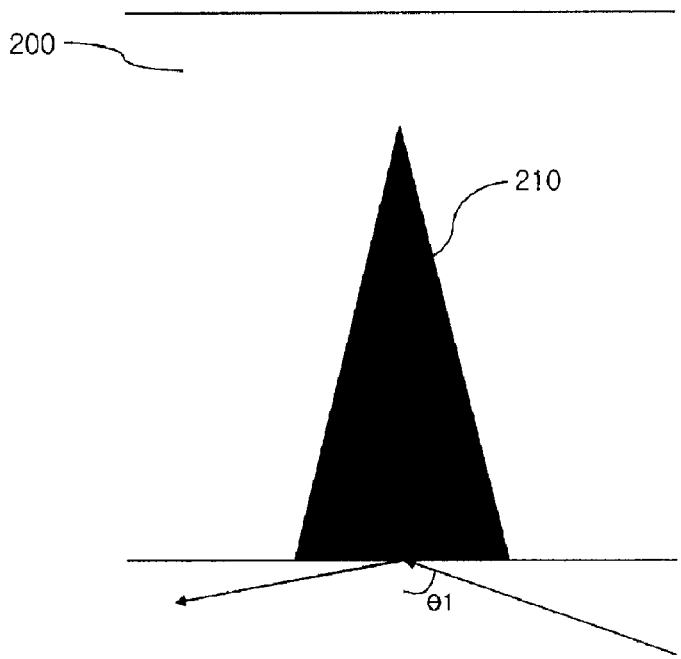
FIGS. 7 to 9 are cross sectional views for explaining a function of an external light shielding sheet in which a bottom of a plurality of pattern units is a concave shape.

Referring to FIG. 7, light that is emitted form the panel and diagonally incident upon the bottom of the pattern units 210 may be reflected toward the panel, when the bottom of the pattern units 210 is flat. As images, to be displayed at a specific position by light reflected toward the panel, are displayed around the specific position, and thus, the sharpness of the display images may be reduced because the bleeding phenomenon such as the ghost phenomenon is generated.

Figure 8:
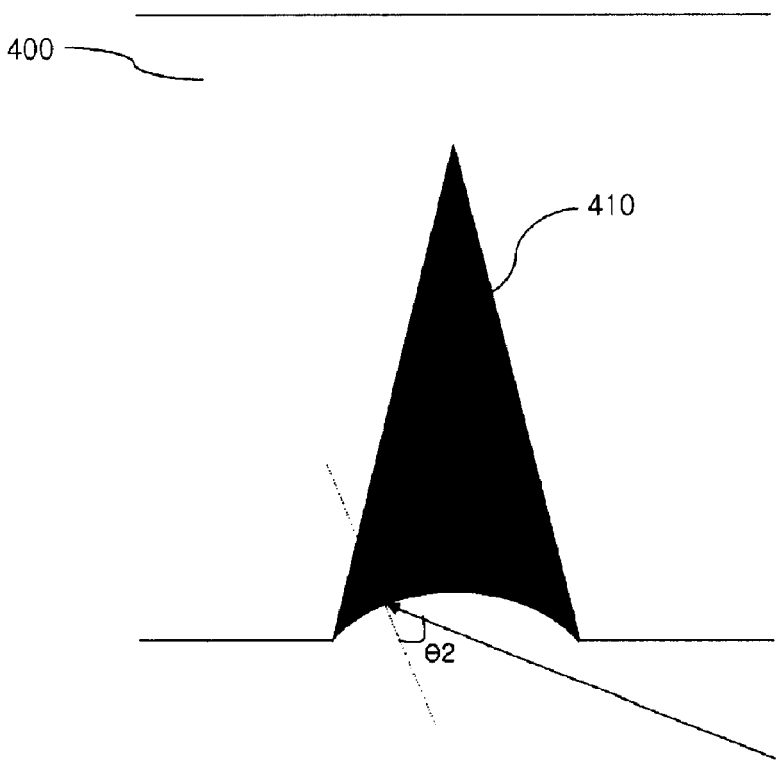

Referring to FIG. 8, the incident angle θ2 that is diagonally incident upon the bottom 420 of the pattern units 410 having a depressed shape is smaller than the incident angle θ1 that is incident upon the bottom of the pattern units 210 having a flat shape. Therefore, the panel light that is reflected on the bottom of the pattern units 210 may be absorbed into the pattern units 410 at the bottom 420 of the pattern units 410 having a depressed shape. Therefore, the sharpness of the display images may be enhanced by reducing the bleeding phenomenon of the display images.

Figure 9:
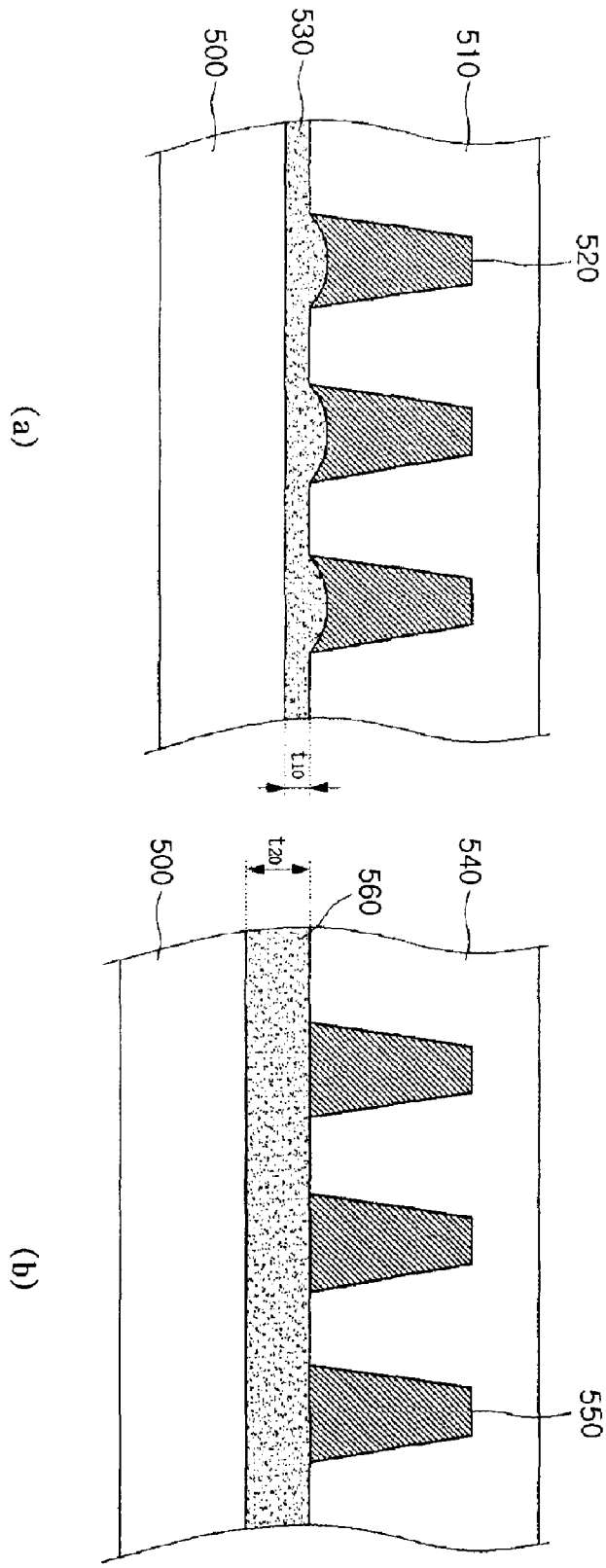

Also, referring to FIG. 9, (a) is when the bottom of the pattern units 520 has a concave shape, and (b) is when the bottom of the pattern units 550 has a flat shape.

In order to attach the external light shielding sheet having these shapes to another functional layer 500 included in the substrate of the panel or the filter, adhesive layers 530, 560 may be interposed between the external light shielding sheet and the substrate or the functional layer 500.

In case of (a), the contact area between the pattern units 520 and the adhesive layer 530 may be increased than the contact area of the case (b), since the bottom of the pattern units 520 has a concave shape. Therefore, the adhesive force of (a) may be greater than the adhesive force of (b), when the thickness of the adhesive layer 530 of (a) and the thickness of the adhesive layer 560 of (b) are same. Also, the same adhesive force between the external light shielding sheet and the substrate or the functional layer 600 may be obtained, even though the thickness t10 of the adhesive layer 530 of (a) is thinner than the thickness t20 of the adhesive layer 560 of (b). Therefore, the manufacturing cost may be reduced by reducing the thickness of the adhesive layer, as the bottom of the pattern units 520 is formed as a concave like (a).

FIGS. 10 to 19 are cross sectional views illustrating the pattern units, in which a bottom of them is formed as a concave, according to embodiments of the present invention.

Figure 10:
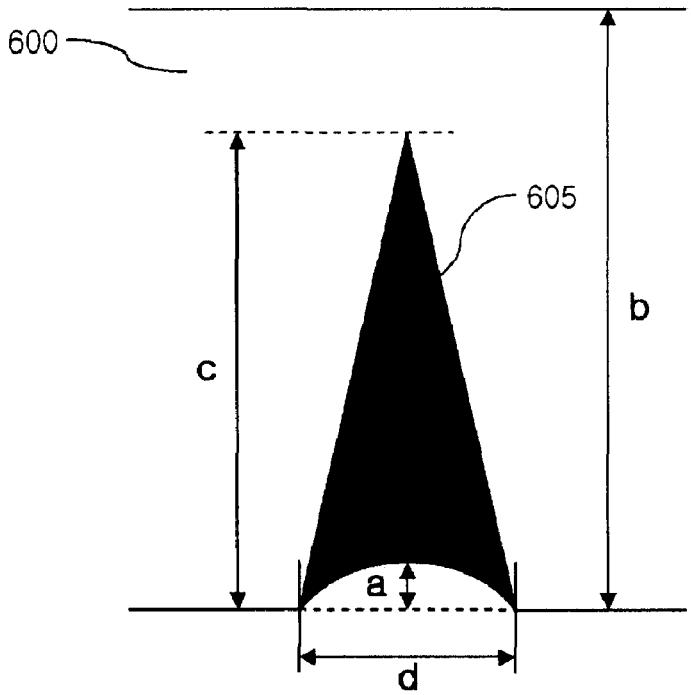
FIGS. 10 to 19 are cross sectional views illustrating a cross sectional shape of an external light shielding sheet according to another embodiments of the present invention.

Referring to FIG. 10, the adhesive force as well as bleeding phenomenon may be enhanced by forming a groove on the bottom of the pattern units 605, thereby having a concave shape.

Table 1 presents experimental results about the bleeding phenomenon of the display images according to the depth a of the groove of the width d of the pattern units 605, that is, Table 1 presents experimental results about whether the bleeding phenomenon of images is reduced or not compared with the PDP in which the external light shielding panel having flat pattern units is arranged.

TABLE 1

| Depth (a) of groove | Bottom width (d) of pattern unit | Reduction of bleeding phenomenon |
|---|---|---|
| 0.5 μm | 27 μm | x |
| 1.0 μm | 27 μm | x |
| 1.5 μm | 27 μm | ○ |
| 2.0 μm | 27 μm | ○ |
| 2.5 μm | 27 μm | ○ |
| 3.0 μm | 27 μm | ○ |
| 3.5 μm | 27 μm | ○ |
| 4.0 μm | 27 μm | ○ |
| 4.5 μm | 27 μm | ○ |
| 5.0 μm | 27 μm | ○ |
| 5.5 μm | 27 μm | ○ |
| 6.0 μm | 27 μm | ○ |
| 6.5 μm | 27 μm | ○ |
| 7.0 μm | 27 μm | ○ |
| 7.5 μm | 27 μm | x |
| 8.0 μm | 27 μm | x |
| 9.0 μm | 27 μm | x |
| 9.5 μm | 27 μm | x |

As described in Table 1, the sharpness of the display images may be enhanced by reducing the bleeding phenomenon of the display images, when a depth a of the depressed groove formed in the bottom of the pattern units 605 is 1.5 μm to 7.0 μm.

When a depth a of the groove formed in the bottom of the pattern units 605 is greater than 7.0 μm, air gap may be formed between the pattern units 605 and another functional layer or adhesive layer. The light emitted from the panel may be reflected or scattered by the air gap. Accordingly, the bleeding phenomenon of the display images may be occurred.

Also, the depth a formed in the bottom of the pattern units 605 is preferably 2 μm to 5 μm in consideration of the protection of the pattern units 605 from the exterior pressure, and the manufacturing facilitation of the pattern units 605.

As described in the above with reference to FIG. 5, it is possible to ensure an optimum opening ratio and maximize external light shielding efficiency, when a bottom width d of the pattern units 605 is 18 μm to 35 μm, and thus, the bottom width d of the pattern units 605 is preferably set to be 3.6 to 17.5 greater than a depth a of a groove formed on the bottom of the pattern units 605.

Meanwhile, it is possible to form a gradient of the slanted surface capable of optimizing the absorption of external light and the reflection of light emitted from the panel, when a height c of the pattern units 605 is 80 μm to 170 μm, and thus, the height c of the pattern units 605 is preferably set to be 16 to 85 times greater than the depth a of the groove formed on the bottom of the pattern units 605 between the pair of adjacent pattern units.

Also, the thickness b of the external light shielding sheet is preferably set to be 20 to 90 times greater than the depth a of the groove formed in the bottom of the pattern units 605, because it is possible to obtain the appropriate transmittance of light emitted from the panel, the absorption and the shielding as well as the durability of the external light shielding sheet when the thickness T of the external light shielding sheet is 100 μm to 180 μm.

Figure 11:
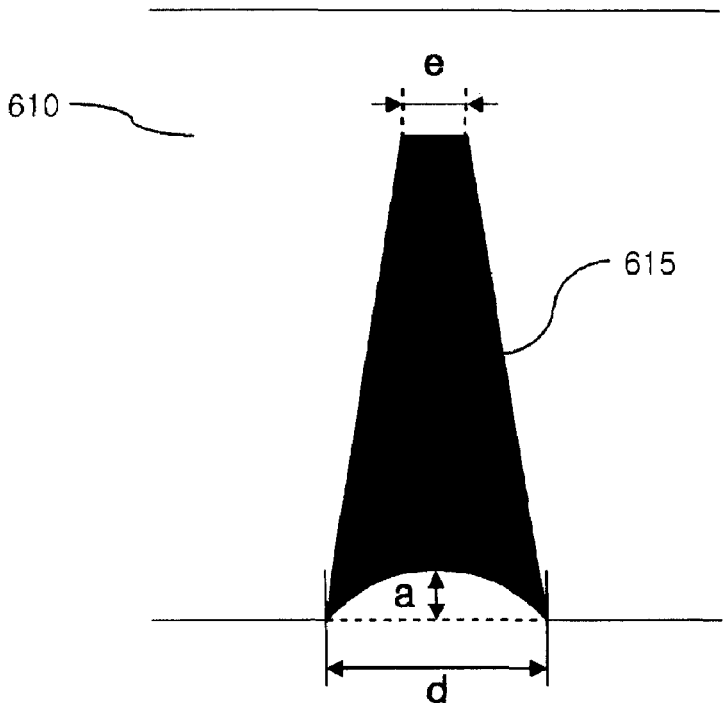

Referring to FIG. 11, the pattern units 615 may be trapezoidal, and in this case, the top width e of the pattern units is preferably less than the bottom width d of the pattern units. Also, when the top width e of the pattern units 615 may be 10 μm or less, and the slope of the slanted surfaces can be determined according to the relationship between the bottom width d so that the absorption of external light and the reflection of light emitted from the panel can be optimized. In this case, relationship between the top width e of the pattern units 615 and the bottom width d of the pattern units 615 may be the same as illustrated in FIG. 10.

Figure 12:
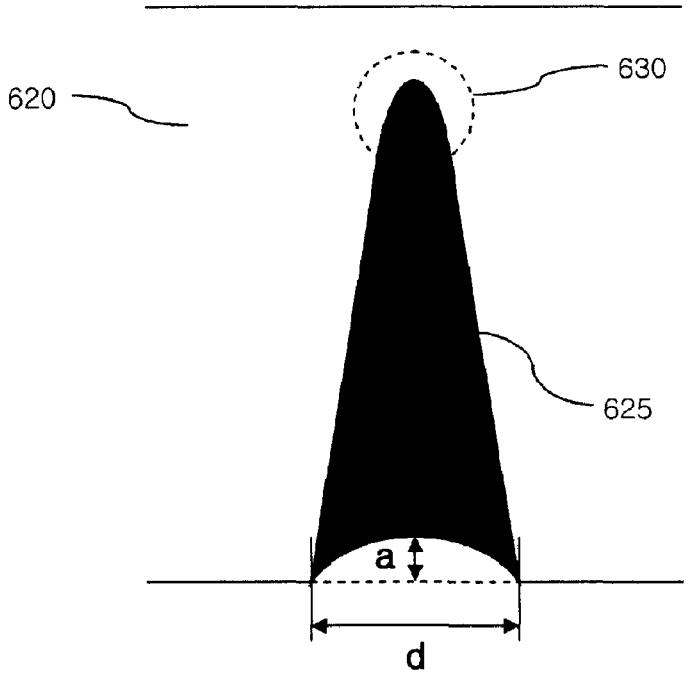

Referring to FIG. 12, the top edge portion 630 of the pattern units may have a curved profile. Also, even though it is not illustrated in FIG. 12, left and right slanted surfaces and the bottom edge portion of the pattern units 625 may have a curved profile having a predetermined curvature. In this case, relationship between the depth a of the groove formed in the bottom of the pattern units 625 and the bottom width d of the pattern units 625 may be the same as illustrated in FIG. 10.

Figure 13:
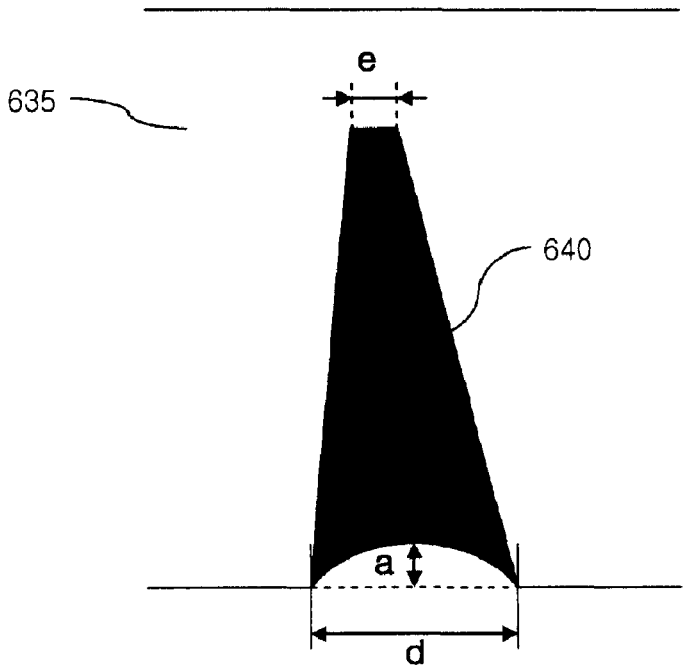

Referring to FIG. 13, the pattern units 640 may be horizontally asymmetrical. That is, left and right slanted surfaces of the pattern units 640 may have different areas or may form different angles with the bottom. In general, an external light source is located above the panel, and thus external light is highly likely to be incident upon the panel from above within a predetermined angle range. Therefore, in order to enhance the absorption of external light and the reflection of light emitted from the panel, one of two slanted surfaces of the pattern units 640 may be less steep than the other of the pattern units 640. In this case, relationship between the depth a of the groove formed in the bottom of the pattern units 640 and the bottom width d of the pattern units 640 may be the same as illustrated in FIG. 10.

Figure 14:
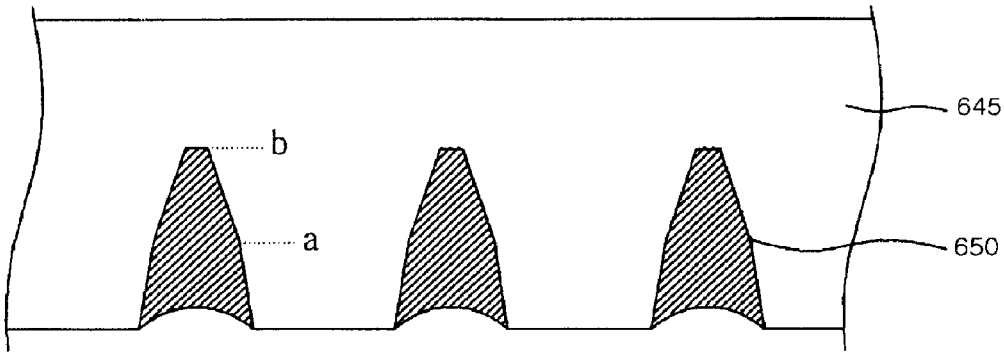

In addition, the slope angle of the slanted surface of the pattern units may not be uniform. That is, the slope angle of the slanted surface of the pattern units 650 may be getting gentle in a direction of the top as illustrated in FIG. 14, or the slope angle of the slanted surface of the pattern units 660 may be getting steep in a direction of the top as illustrated in FIG. 15.

Figure 15:
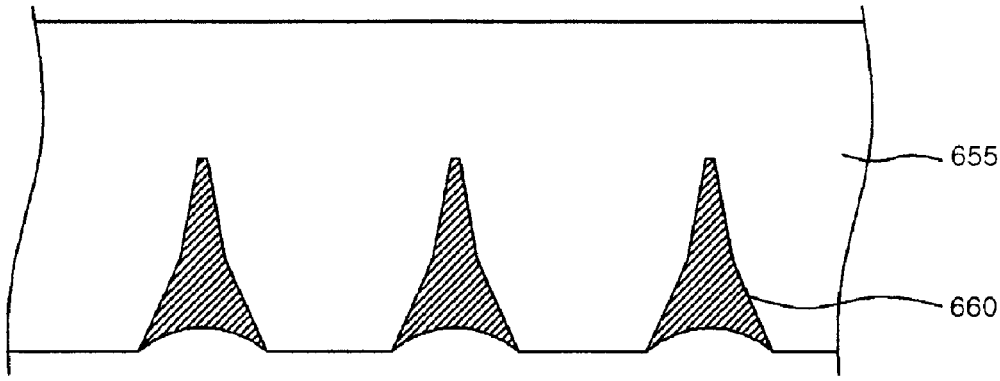
Figure 16:
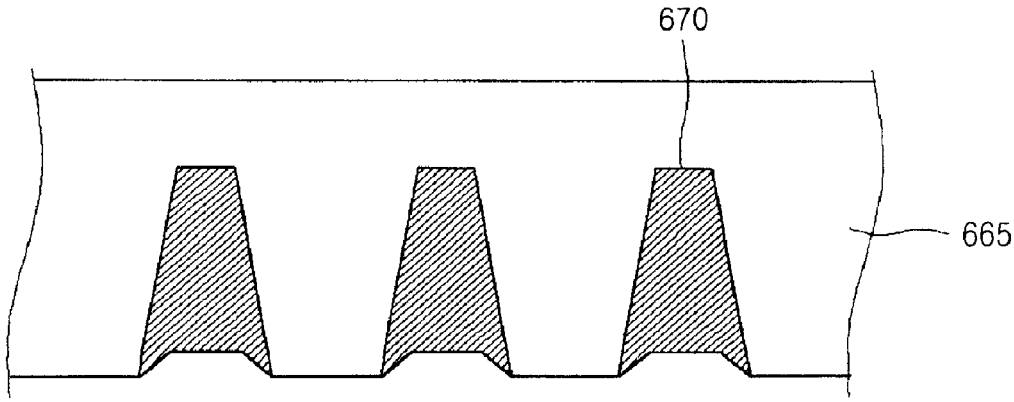

FIGS. 15 and 16 illustrate that the slope angle of the slanted surface of the pattern units 650, 660 is changed at the center (a), however the slope angle of the slanted surface of the pattern units may be 3 or more and the slanted surface of the pattern units may also have concave or convex shapes.

As illustrated in FIGS. 16 to 19, a concave groove that is formed in the bottom of the pattern units may formed as various shapes. Referring to FIG. 16, a trapezoidal, concave groove may be formed in the bottom of the pattern units 670.

Figure 17:
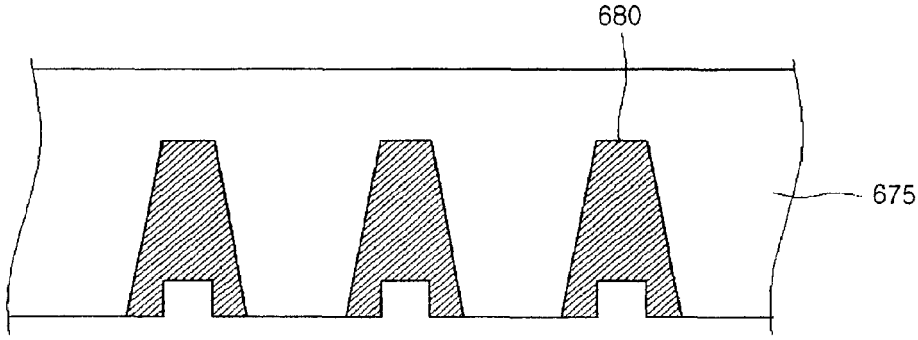
Figure 18:
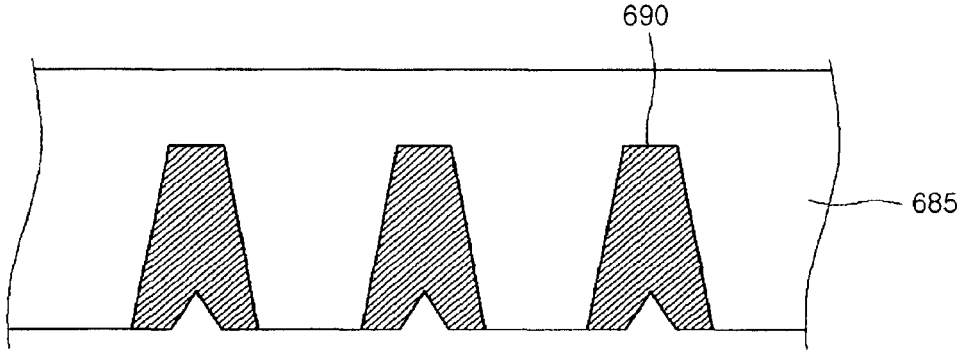

Also, as illustrated in FIG. 17, a rectangular groove may be formed in the bottom of the pattern units 680, or a triangular groove may be formed in the bottom of the pattern units 690.

The shape of the concave groove that is formed in the bottom of the pattern units is not restricted to these shapes illustrated in FIGS. 10 to 19, various shapes capable of increasing the contact area between the substrate of the panel and the functional layer of the filter and of reducing the bleeding phenomenon of images may be used.

Figure 19:
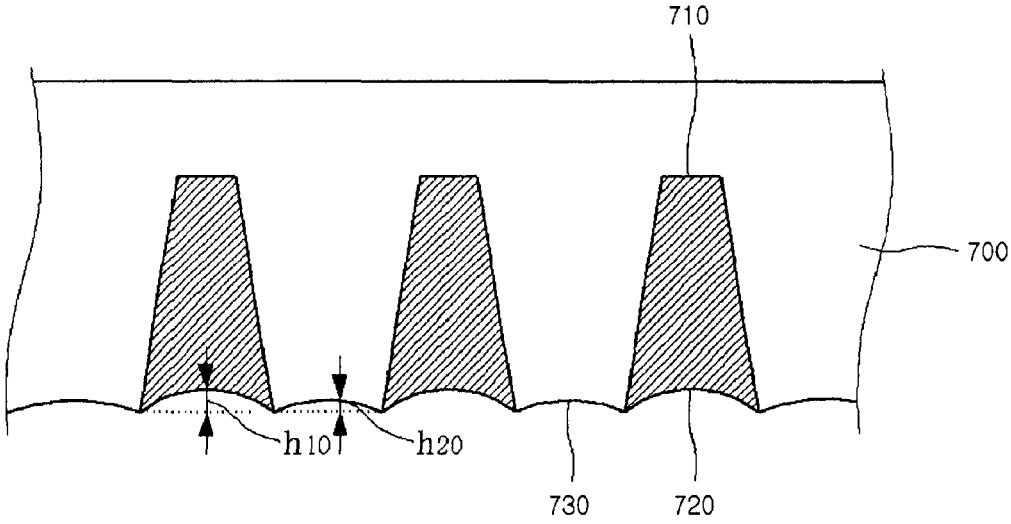

Referring to FIG. 19, a concave groove 730 may be formed in the bottom of the base unit 700. The adhesive force may further be increased by increasing the contact area between the substrate of the panel and the functional layer of the filter, as the groove 730 is formed in the same direction to the groove 720 formed in the pattern units 710, that is, the bottom of the base unit 700.

The depth h20 of the groove 720 is preferably smaller than the depth h10 of the groove 720 formed in the bottom of the pattern units 710 in order to prevent the reduction of the opening ratio as the dark color materials constituting the pattern units 710 are filled into the groove 720 of the base unit 700.

Figure 20:
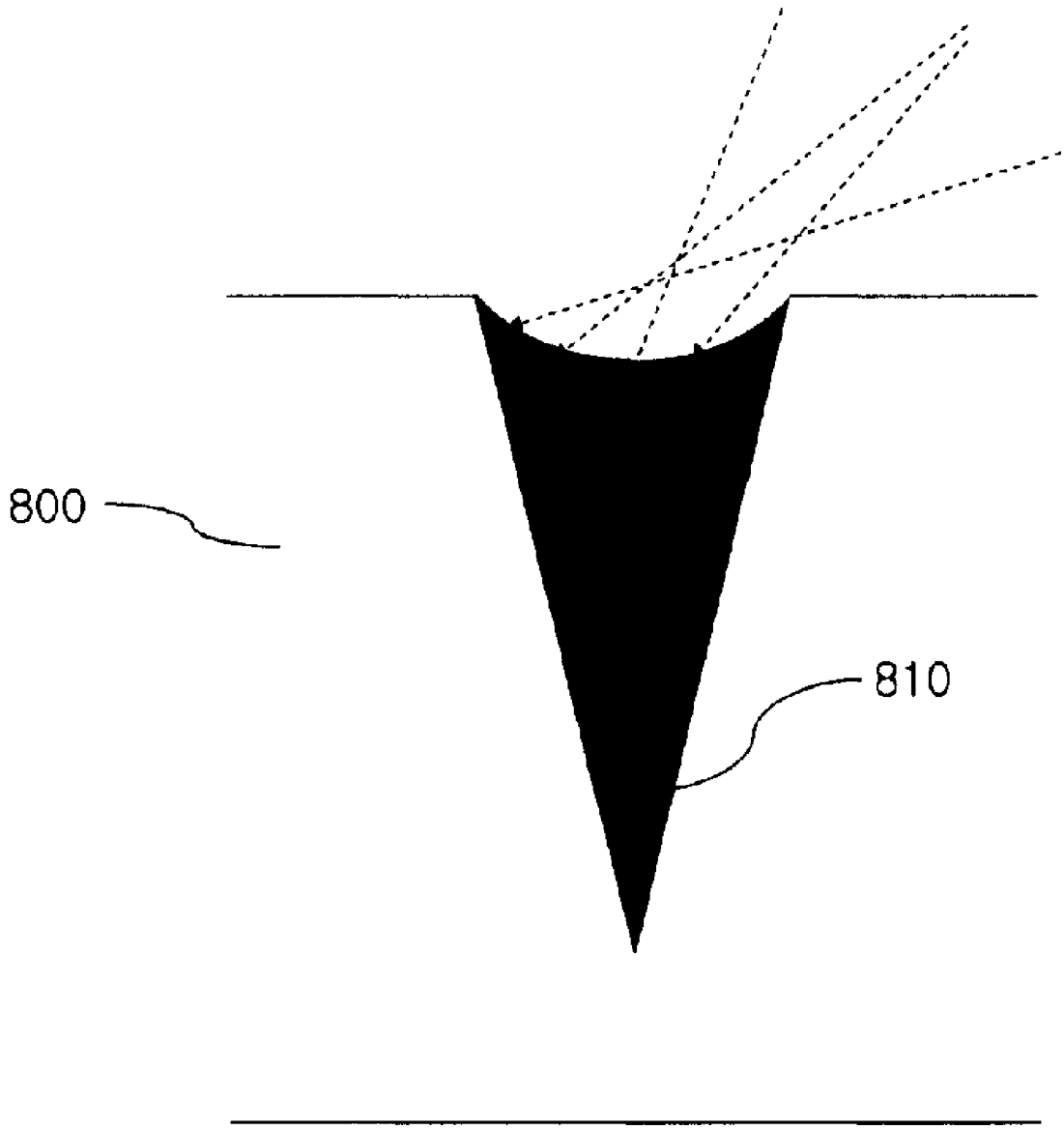
FIG. 20 is a cross sectional view illustrating a cross sectional shape of an external light shielding sheet, in which a bottom of a plurality of pattern units is arranged at a viewer side, according to embodiments of the present invention.

FIG. 20 illustrates a bottom of the pattern units 810 having a concave shape, which is arranged at a viewer side.

Figure 23:
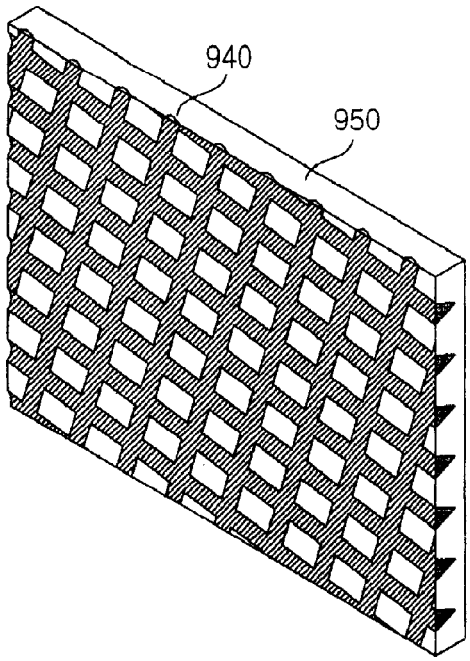

Referring to FIG. 23, incident angle of external light that is absorbed in the bottom of the pattern units 810 can be increased by forming the bottom of the pattern units 710 as a concave. That is, when the bottom of the pattern units 810 is formed as a concave, the incident angle of external light that is incident upon the bottom of the pattern units 810 may be increased, and thus, the absorption of external light can be increased.

The thickness T of the external light shielding sheet according to the present invention is preferably set to 100 μm to 180 μm in order to obtain appropriate transmittance ratio of visible light emitted from the panel for displaying images as well as to enhance the durability of the external light shielding sheet.

When the height h provided in the external light shielding sheet is 80 μm to 170 μm, the manufacture of the external light shielding sheet can be facilitated, the appropriate opening ratio of the external light shielding sheet can be obtained, and the function of shielding external light and the function of reflecting light emitted from the panel can be maximized.

The height h of the pattern units can be varied according to the thickness T of the external light shielding sheet. In general, external light that considerably affects the bright room contrast of the panel is highly likely to be incident upon the panel from the above. Therefore, in order to effectively shield external light, the height h of the pattern units is preferably within a predetermined percentage of the thickness T of the external light shielding sheet.

As the height h of the pattern units increases, the thickness of the base unit, which is top region of the pattern units, decreases, and thus, dielectric breakdown may occur. On the other hand, as the height h of the pattern units decreases, more external light is likely to be incident upon the panel at various angles within a predetermined range, and thus the external light shielding sheet may not properly shield the external light.

Table 2 presents experimental results about the dielectric breakdown and the external light shielding effect of the external light shielding sheet according to the thickness T of the external light shielding sheet and the height h of the pattern units.

TABLE 2

| Thickness (T) of external light shielding sheet | Height (h) of pattern units | Dielectric breakdown | External light shielding |
|---|---|---|---|
| 120 μm | 120 μm | ○ | ○ |
| 120 μm | 115 μm | Δ | ○ |
| 120 μm | 110 μm | x | ○ |
| 120 μm | 105 μm | x | ○ |
| 120 μm | 100 μm | x | ○ |
| 120 μm | 95 μm | x | ○ |
| 120 μm | 90 μm | x | ○ |
| 120 μm | 85 μm | x | Δ |
| 120 μm | 80 μm | x | Δ |
| 120 μm | 75 μm | x | Δ |
| 120 μm | 70 μm | x | Δ |
| 120 μm | 65 μm | x | Δ |
| 120 μm | 60 μm | x | Δ |
| 120 μm | 55 μm | x | Δ |
| 120 μm | 50 μm | x | x |

Referring to Table 2, when the thickness T of the external light shielding sheet is 120 μm or more, and the height h of the pattern units 115 μm or more, the pattern units are highly likely to dielectric breakdown, thereby increasing defect rates of the product. When the height h of the pattern units 115 μm or less, the pattern units are less likely to dielectric breakdown, thereby reducing defect rates of the external light shielding sheet. However, when the height h of the pattern units is 85 μm or less, the shielding efficiency of external light may be reduced, and when the height h of the pattern units is 60 μm or less, external light is likely to be directly incident upon the panel. Therefore, when the height h of the pattern units is 90 μm to 110 μm, the shielding efficiency of the external light shielding sheet may be increased as well as the defect rates of the external light shielding sheet may be decreased.

In addition, when the thickness T of the external light shielding sheet is 1.01 to 2.25 times greater than the height h of the pattern units, it is possible to prevent the top portion of the pattern units from dielectrically breaking down and to prevent external light from being incident upon the panel. Also, in order to prevent dielectric breakdown and infiltration of external light into the panel, to increase the reflection of light emitted from the panel, and to secure optimum viewing angles, the thickness T the external light shielding sheet may be 1.01 to 1.5 times greater than the height h of the pattern units.

Table 3 presents experimental results about the occurrence of the moire phenomenon and the external light shielding effect of the external light shielding sheet according to different pattern unit bottom width P1-to-bus electrode width ratios, when the width of the bus electrode is 70 μm.

TABLE 3

| Bottom width of pattern units/Width of bus electrodes | Moire | External light shielding |
|---|---|---|
| 0.10 | Δ | x |
| 0.15 | Δ | x |
| 0.20 | x | Δ |
| 0.25 | x | ○ |
| 0.30 | x | ○ |
| 0.35 | x | ○ |
| 0.40 | x | ○ |
| 0.45 | Δ | ○ |
| 0.50 | Δ | ○ |

TABLE 3-continued

| Bottom width of pattern units/Width of bus electrodes | Moire | External light shielding |
|---|---|---|
| 0.55 | ○ | ○ |
| 0.60 | ○ | ○ |

Referring to Table 3, when the bottom width of the pattern units is 0.2 to 0.5 times greater than the bus electrode width, the moire phenomenon can be reduced as well as external light incident upon the panel can be reduced. Also, in order to prevent the moire phenomenon, to effectively shield external light, and to secure a sufficient opening ratio for discharging light emitted from the panel, the bottom width of the pattern units is preferably 0.25 to 0.4 times greater than the bus electrode width.

Table 4 presents experimental results about the occurrence of the moire phenomenon and the external light shielding effect according to different pattern unit bottom width of the external light shielding sheet-to-vertical barrier rib width ratios, when the width of the vertical barrier rib is 50 μm.

TABLE 4

| Bottom widths of pattern units/Top width of vertical barrier ribs | Moire | External light shielding |
|---|---|---|
| 0.10 | ○ | x |
| 0.15 | Δ | x |
| 0.20 | Δ | x |
| 0.25 | Δ | x |
| 0.30 | x | Δ |
| 0.35 | x | Δ |
| 0.40 | x | ○ |
| 0.45 | x | ○ |
| 0.50 | x | ○ |
| 0.55 | x | ○ |
| 0.60 | x | ○ |
| 0.65 | x | ○ |
| 0.70 | Δ | ○ |
| 0.75 | Δ | ○ |
| 0.80 | Δ | ○ |
| 0.85 | ○ | ○ |
| 0.90 | ○ | ○ |

Referring to Table 4, when the bottom width of the pattern units is 0.3 to 0.8 times greater than the top width of the vertical barrier rib, the moire phenomenon can be reduced as well as external light incident upon the panel can be reduced. Also, in order to prevent the moire phenomenon, to effectively shield external light, and to secure a sufficient opening ratio for discharging light emitted from the panel, the bottom width of the pattern units is preferably 0.4 to 0.65 times greater than the top width of the vertical barrier rib.

FIGS. 21 to 24 are perspective views illustrating the shape of a front surface of an external light shielding sheet according to embodiments of the present invention.

Figure 21:
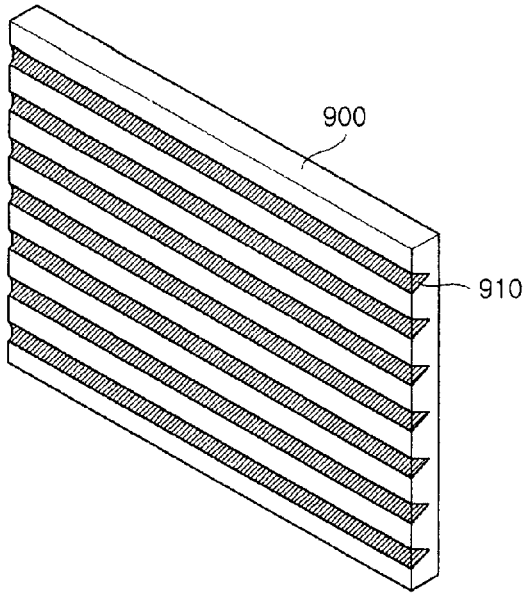
FIGS. 21 to 24 are perspective views illustrating a front surface shape of an external light shielding sheet according to embodiments of the present invention.
Figure 22:
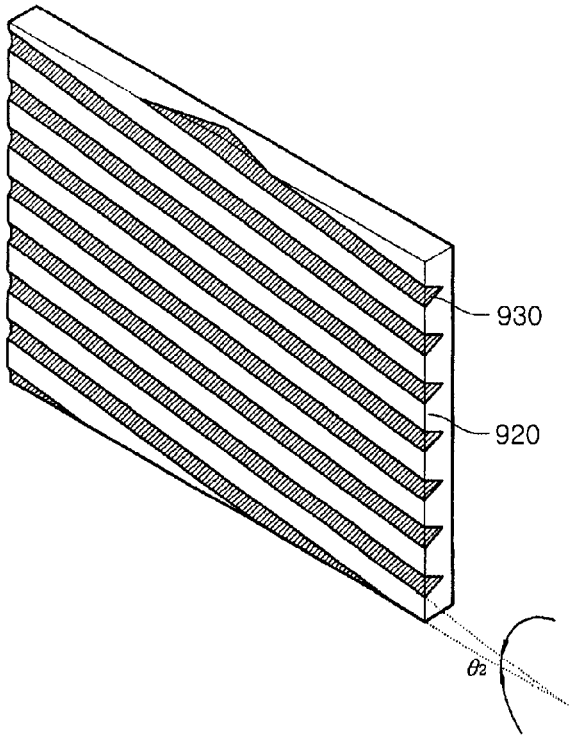

The shape of the front surface of the external light shielding sheet may be formed in which the pattern units 910 is parallel to the longer side of the base unit 900 as illustrated in FIG. 21, or the pattern units 910 is diagonally to the longer side of the base unit 920 at a predetermined angle θ2 as illustrated in FIG. 22.

The occurrence of interference fringe caused by the interference between at least two periodic patterns, that is the moire phenomenon can be reduced by diagonally forming the pattern units 930 so that the angle between the pattern units 930 and the longer side of the base unit 920 is 1 to 20°.

Figure 24:
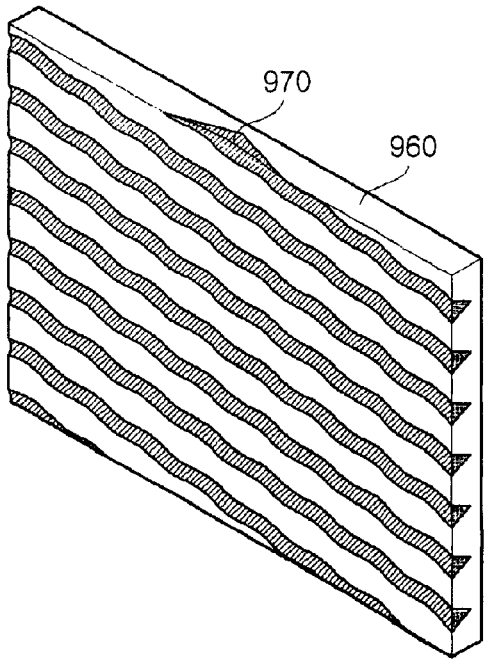

Also, as illustrated in FIGS. 23 and 24, the shape of the front surface of the pattern units may be formed to intersect.

Referring to FIG. 23, the pattern units 940 may be formed as a matrix type, or the pattern units 970 may be formed as a wave type as illustrated in FIG. 24.

FIGS. 25 to 28 are cross-sectional views illustrating a structure of a filter according to embodiments of the present invention. The filter formed at a front of the PDP may include an anti-reflection (AR)/near infrared (NIR) sheet, an electromagnetic interference (EMI) sheet, an external light shielding sheet and an optical sheet.

Figure 25:
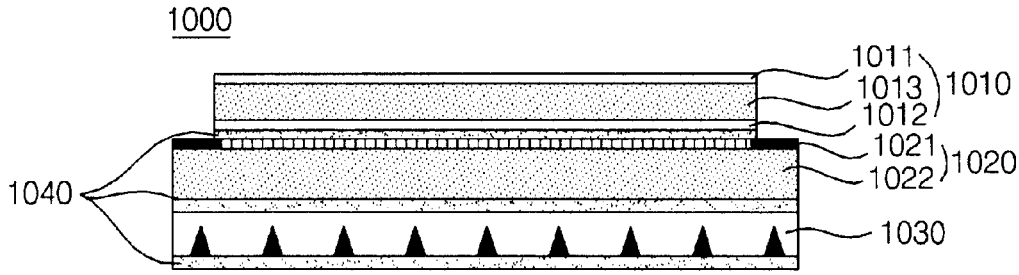
FIGS. 25 to 28 are cross sectional views illustrating a structure of a filter according to embodiments of the present invention.
Figure 26:
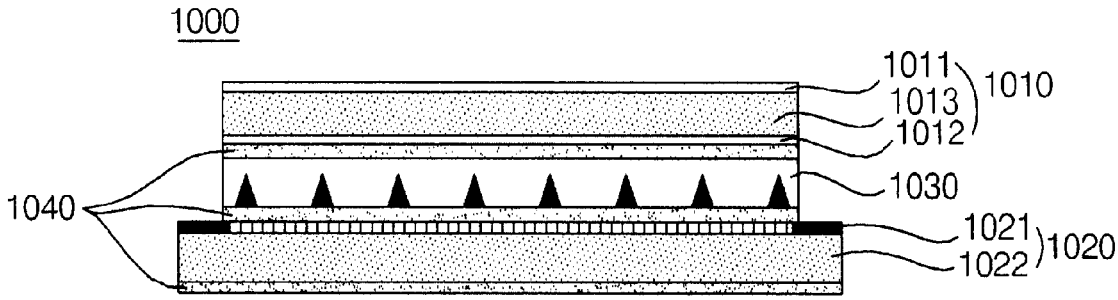

Referring to FIGS. 25 and 26, an anti-reflection (AR) layer 1011 which is attached onto a front surface of the base sheet 1013 and reduces glare by preventing the reflection of external light from the outside is attached onto the AR/ NIR sheet 1010, and a near infrared (NIR) shielding layer 1012 which shields NIR rays emitted from the panel so that signals provided by a device such as a remote control which transmits signals using infrared rays can be normally transmitted is attached onto a rear surface of the AR/NIR sheet 1010.

The electromagnetic interference (EMI) sheet 1020 includes an electromagnetic interference (EMI) layer 1021 which is attached onto a front surface of the base sheet 1022 which is formed of a transparent plastic material and shields EMI emitted from the panel so that the EMI can be prevented from being released to the outside. Here, the electromagnetic interference (EMI) layer 1021 is generally formed of a conductive material in a mesh form. An invalid display area of the electromagnetic interference (EMI) sheet 1020 where no image is displayed is covered with a conductive material in order to properly ground the electromagnetic interference (EMI) layer.

In general, an external light source is mostly located over the head of a viewer regardless of an indoor or outdoor environment. The external light shielding sheet 1030 is attached thereto so that external light is effectively shielded and thus black images of the PDP can be rendered even blacker.

An adhesive layer 1040 is interposed between the AR/NIR sheet 1010, the electromagnetic interference (EMI) sheet 1020 and the external light shielding sheet 1030, so that the sheets 1010, 1020, 1030 and the filter 1000 can be firmly attached onto the front surface of the panel. Also, the base sheets interposed between the sheets are preferably made of the same material in order to facilitate the manufacture of the filter 1000.

Meanwhile, referring to FIG. 25, the AR/NIR sheet 1010, the electromagnetic interference (EMI) sheet 1020, and the external light shielding sheet 1030 are sequentially stacked. Alternatively, the AR/NIR sheet 1010, the external light shielding sheet 1030 and the electromagnetic interference (EMI) sheet 1020 may be sequentially stacked, as illustrated in FIG. 26. The order in which the AR/NIR sheet 1010, the electromagnetic interference (EMI) sheet 1020 and the external light shielding sheet 1030 are stacked is not restricted to those set forth herein. Also, at least one of the AR/NIR sheet 1010, the electromagnetic interference (EMI) sheet 1020 and the external light shielding sheet 1030 can be omitted.

Figure 27:
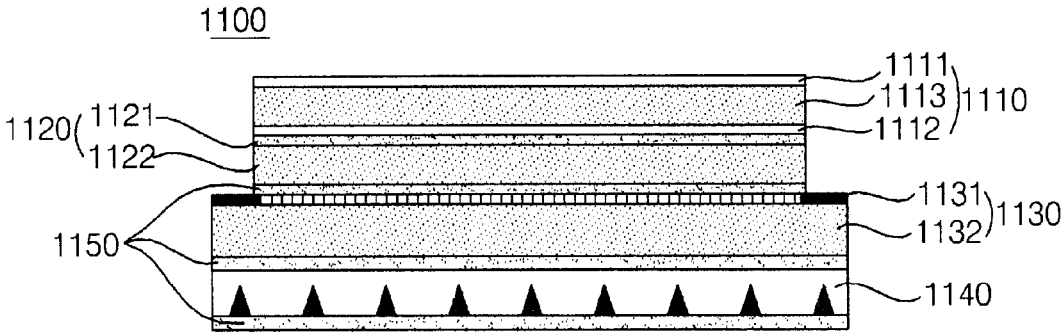
Figure 28:
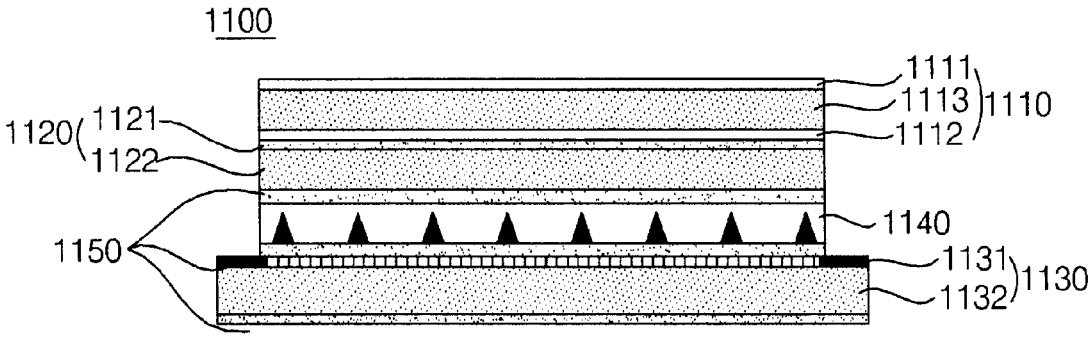

Referring to FIGS. 27 and 28, a filter 1100 disposed at the front surface of the panel may further include an optical sheet 1120 as well as an AR/NIR sheet 1110, an electromagnetic interference (EMI) sheet 1130 and an external light shielding sheet 1140. The optical sheet 1120 enhances the color temperature and luminance properties of light from the panel, and an optical sheet layer 1121 which is formed of a dye and an adhesive is stacked on a front or rear surface of the base sheet 1122 which is formed of a transparent plastic material.

At least one of the base sheets illustrated in FIGS. 25 to 28 may be abbreviated, and at least one of the base sheets may be formed of a hard glass instead of being formed of a plastic material, so that the protection of the panel can be enhanced. It is preferable that the glass is formed at a predetermined spacing apart from the panel.

In addition, the filter according to the present invention may further include a diffusion sheet. The diffusion sheet serves to diffuse light incident upon the panel to maintain the uniform brightness. Therefore, the diffusion sheet may widen the vertical viewing angle and conceal the patterns formed on the external light shielding sheet by uniformly diffusing light emitted from the panel. Also, the diffusion sheet may enhance the front luminance as well as antistatic property by concentrating light in the direction corresponding to the vertical viewing angle.

As a diffusion sheet, a transmissive diffusion film or a reflective diffusion film can be used. The diffusion sheet may have the mixed form that small glass particles are mixed in the base sheet of polymer material. Also, PMMA may be used as a base sheet of the diffusion film. When PMMA is used as a base sheet of the diffusion film, it can be used in large display devices because thermal resistance of the base sheet is good enough despite of it's thick thickness.

The plasma display device of the present invention can effectively realize black images and enhance bright room contrast, as an external light shielding sheet, which absorbs and shields as much external light incident upon a plasma display panel PDP as possible, is disposed at a front of the plasma display panel. Also, the sharpness of the display images may be enhanced by reducing the bleeding phenomenon of the display images as well as the adhesiveness of the filter may be enhanced by forming the bottom of the pattern units of the external light shielding sheet as a concave shape in which the center area is depressed into the inside.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display device, comprising:

a plasma display panel (PDP); and a filter which is formed at a front of the PDP, wherein:

the filter includes an external light shielding sheet which comprises a base unit, and a plurality of pattern units that are formed on the base unit, the plurality of pattern units are parallel to each other, several of the pattern units have a top and a bottom, the bottom being wider than the top, a structure with a concave shape having a curvature located in the bottom of each of the several pattern units, a bottom width of each of the several pattern units is 3.6 to 17.5 times greater than a depth of the structure located in the bottom of each of the several pattern units.

2. The plasma display device of claim 1, wherein a depth of the structure located in the bottom of each of the several pattern units is 1.5 μm to 7 μm.

3. The plasma display device of claim 1, wherein a depth of the structure located in the bottom of each of the several pattern units is 2 μm to 5 μm.

4. The plasma display device of claim 1, wherein a height of each of the several pattern units is 16 to 85 times greater than a depth of the structure located in the bottom of each of the several pattern units.

5. The plasma display device of claim 1, wherein a thickness of the external light shielding sheet is 20 to 90 times greater than a depth of the structure located in the bottom of each of the several pattern units.

6. The plasma display device of claim 1, wherein a refractive index of the plurality of pattern units is 0.3-1 times a refractive index of the base unit.

7. The plasma display device of claim 1, wherein a refractive index of the plurality of pattern units is 1.0-1.3 times a refractive index of the base unit.

8. The plasma display device of claim 1, wherein a thickness of the external light shielding sheet is 1.01 to 2.25 times a height of the plurality of pattern units.

9. The plasma display device of claim 1, wherein a distance between bottoms of a pair of adjacent pattern units of the plurality of pattern units is 1.1 to 5 times greater than a bottom width of the pair of adjacent pattern units.

10. The plasma display device of claim 1, wherein a height of the plurality of pattern units is 0.89 to 4.25 times a distance between bottoms of a pair of adjacent pattern units of the plurality of pattern units.

11. A filter, comprising:

a base unit; and a plurality of pattern units that are formed on the base unit, wherein:

the plurality of pattern units are parallel to each other, several of the pattern units have a top and a bottom, the bottom being wider than the top, a structure with a concave shape having a curvature located in the bottom of each of the several pattern units, and a bottom width of each of the several pattern units is 3.6 to 17.5 times greater than a depth of the structure located in the bottom of each of the several pattern units.

12. The filter of claim 11, wherein a depth of the structure located in the bottom of each of the several pattern units is 1.5 μm to 7 μm.

13. The filter of claim 11, wherein a height of each of the several pattern units is 16 to 85 times greater than a depth of the structure located in the bottom of each of the several pattern units.

14. The filter of claim 11, wherein a thickness of the external light shielding sheet is 20 to 90 times greater than a depth of the structure located in the bottom of each of the several pattern units.

15. The filter of claim 11, wherein a refractive index of the plurality of pattern units is 0.3-1 times a refractive index of the base unit.

16. The filter of claim 11, wherein a refractive index of the plurality of pattern units is 1.0-1.3 times a refractive index of the base unit.

17. The filter of claim 11, wherein a thickness of the external light shielding sheet is 1.01 to 2.25 times a height of the plurality of pattern units.

* * * * *